US009204672B2

(12) United States Patent
Crissman

(10) Patent No.: US 9,204,672 B2
(45) Date of Patent: Dec. 8, 2015

(54) UNDERWEAR BRIEF

(71) Applicant: Roger Crissman, Santa Cruz, CA (US)

(72) Inventor: Roger Crissman, Santa Cruz, CA (US)

( * ) Notice: Subject to any disclaimer, the term of this patent is extended or adjusted under 35 U.S.C. 154(b) by 287 days.

(21) Appl. No.: 13/968,806

(22) Filed: Aug. 16, 2013

(65) Prior Publication Data

US 2015/0047107 A1 Feb. 19, 2015

(51) Int. Cl.
*A41B 9/02* (2006.01)
*A41B 9/00* (2006.01)

(52) U.S. Cl.
CPC *A41B 9/023* (2013.01); *A41B 9/007* (2013.01)

(58) Field of Classification Search
CPC ..... A41D 1/00; A41D 1/09
USPC ..... 2/400, 401, 403, 405
See application file for complete search history.

(56) References Cited

U.S. PATENT DOCUMENTS

| | | | | |
|---|---|---|---|---|
| 2,138,481 | A | 11/1938 | Chatfield | |
| 2,282,218 | A | 5/1942 | Flesh | |
| 3,119,120 | A * | 1/1964 | Faust | 2/405 |
| 3,207,155 | A * | 9/1965 | Cullen | 602/67 |
| 4,195,630 | A | 4/1980 | Connery et al. | |
| 4,951,321 | A * | 8/1990 | Mortensen et al. | 2/408 |
| 4,955,088 | A * | 9/1990 | Terjesen | 2/403 |
| 4,961,419 | A | 10/1990 | Tribble et al. | |
| 5,870,779 | A | 2/1999 | Heron | |
| 6,061,839 | A * | 5/2000 | Smolik | 2/400 |
| 6,415,450 | B1 | 7/2002 | Lien | |
| 6,487,833 | B1 * | 12/2002 | Jaenson et al. | 53/399 |
| 6,964,065 | B2 * | 11/2005 | Stevenson | 2/400 |
| 7,823,223 | B2 * | 11/2010 | Ehmsen | 2/408 |
| 2005/0235399 | A1 | 10/2005 | Kang | |
| 2008/0189833 | A1 * | 8/2008 | Jin | 2/405 |
| 2015/0047108 | A1 * | 2/2015 | Crissman | 2/405 |

FOREIGN PATENT DOCUMENTS

| | | | |
|---|---|---|---|
| GB | 459968 | A | 1/1937 |
| JP | 2645808 | B2 | 8/1997 |
| JP | 2004256978 | A2 | 9/2004 |

* cited by examiner

*Primary Examiner* — Gloria Hale
(74) *Attorney, Agent, or Firm* — Donald R. Boys; Central Coast Patent Agency, Inc.

(57) ABSTRACT

A male underwear brief has an elastic waistband, material joined to the waistband, contiguously forming a back panel, an upper front panel, and a crotch panel, a first and a second leg opening for a person's legs, edges of the leg openings reinforced with elastic material, and a horizontal fly opening in front, wherein the back panel and the crotch panel are joined to the reinforced edges of the leg openings, the crotch panel proceeding upward in front ending at a first edge attached to the crotch panel and to each of the leg openings, and the front panel is joined to the edges of the leg openings, ending at a second edge attached to each of the edges of the leg openings overlapping the first edge below the first edge, the overlapped material forming a horizontal fly that opens upward into the brief between the first and second edges.

2 Claims, 8 Drawing Sheets

UNDERWEAR BRIEF

BACKGROUND OF THE INVENTION

1. Field of the Invention

The present invention is in the field of garments and is more particularly related to an undergarment for men.

2. Description of Related Art

Various forms of undergarments have been developed over the ages for men. The currently available briefs for men are generally constructed with one or more trunk panels and overlapping front panels. The overlapping front panels typically define a singular fly opening for access through the outermost panel to the penis for the purpose of urination. Several attempts have been made to solve the numerous problems associated with the known brief constructions, such as discomfort, lack of support and embarrassment due to unsightly bulging or slippage of the male genital organs. Hence there is clearly a need for a male underwear brief with various options for supporting and exposing the male genital organ in different ways and to provide a comfortable wearing for 24 hours continuously in a day.

BRIEF SUMMARY OF THE INVENTION

In an embodiment of the invention a male underwear brief is provided, comprising an elastic waistband, cloth material joined circumferentially to the waistband, contiguously forming a back panel, an upper front panel, and a crotch panel proceeding from a lower region of the back panel to the front and upward, a first and a second leg opening for a person's legs, edges of the leg openings reinforced with elastic material, and a horizontally oriented and aligned fly opening in front. The back panel and the crotch panel are joined to the reinforced edges of the leg openings, the crotch panel proceeding upward in front ending at a first edge attached continuously to the crotch panel and to each of the reinforced edges of the leg openings, and the upper front panel is joined to the reinforced edges of the leg openings, ending at a second edge attached to each of the reinforced edges of the leg openings overlapping the first edge below the first edge, the overlapped material forming a horizontal fly that opens upward into the brief between the first and second edges.

In one embodiment the underwear brief further comprises a first elastic band joined continuously along the first edge, attached to the reinforced edges of the leg openings. Also in one embodiment the underwear brief further comprises a first elastic band joined continuously along the second edge, and attached to the reinforced edges of the leg openings. Still in one embodiment the underwear brief further comprises a first elastic band joined continuously along the first edge, attached to the reinforced edges of the leg openings, and a second elastic band joined continuously along the second edge, attached to the reinforced edges of the leg openings. In one embodiment there is a third horizontal elastic band joined only to each of the reinforced edges of the leg openings over the upper front panel above and parallel to the first and second horizontal elastic bands.

In another embodiment of the male underwear brief the upper front panel comprises material such that the upper front panel joined to the reinforced edges of the leg openings from the second elastic band upwards to a first point on the reinforced edges of the leg openings a specific distance along the reinforced edges of the leg openings from the lower edge of the second elastic band, and joined from above to the reinforced edges of the leg openings down to a second point on the reinforced edges of the leg openings lower on the leg openings from the first point, creates an extension loop of two layers of material extending to the front a distance equal to the specific distance and ending in a folded edge, which extension, folded down along a line from the first point on the reinforced edges of the leg openings, positions the folded edge of the extension along the lower edge of the first and second elastic bands, and the extension, then joined to the reinforced edges of the leg openings, forms a pouch from inside the underwear brief.

Also in one embodiment the third elastic band is positioned horizontally across the leg openings under the material of the front panel just below the second points, forming a support for the pouch formed. In yet another embodiment a pouch is formed by controlling the cut of the upper front panel to provide sufficient width such that the upper front panel, joined to the reinforced edges of the leg openings, provides a forward extending pouch.

BRIEF DESCRIPTION OF SEVERAL VIEWS OF DRAWINGS

FIG. 1*a* is a side perceptive view of a male underwear brief, according to an embodiment of the present invention.

FIG. 1*b* is a cross-section through a fly of the brief of FIG. 1*a*, according to an embodiment of the invention.

FIG. 1*c* is through a fly of the brief of FIG. 1*a*, according to an embodiment of the invention.

Figure 8A:
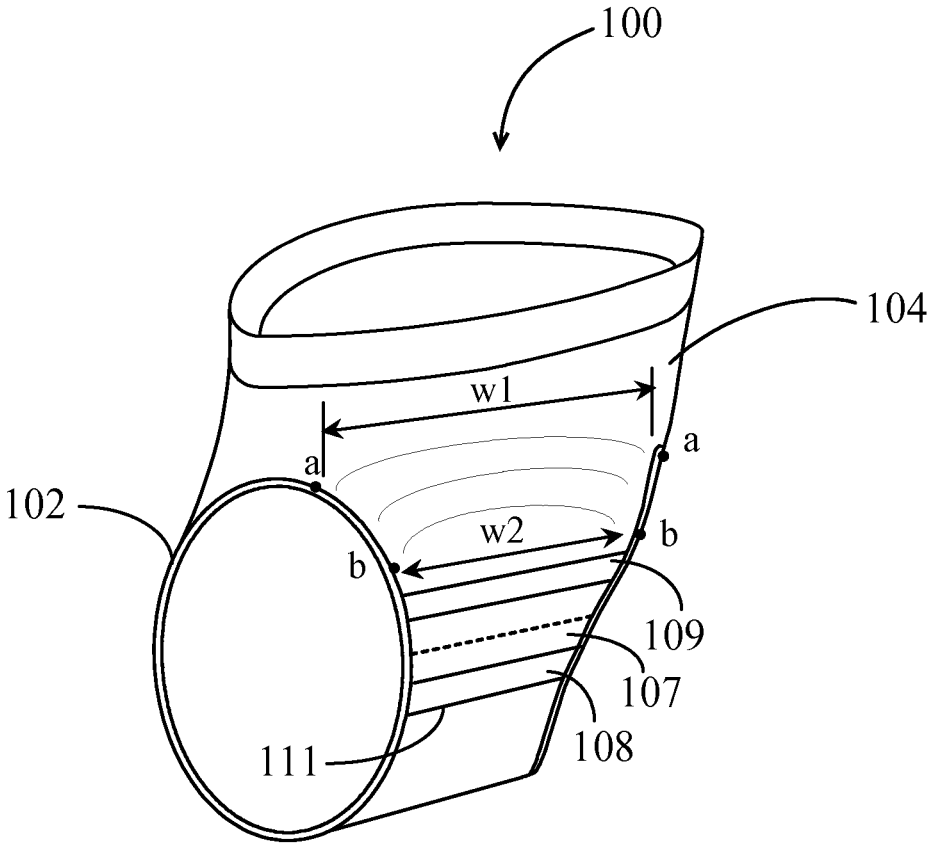

FIG. 8*a* is a side perceptive view of a male underwear brief illustrating an alternative process for making a pouch, according to an embodiment of the present invention.

Figure 8B:
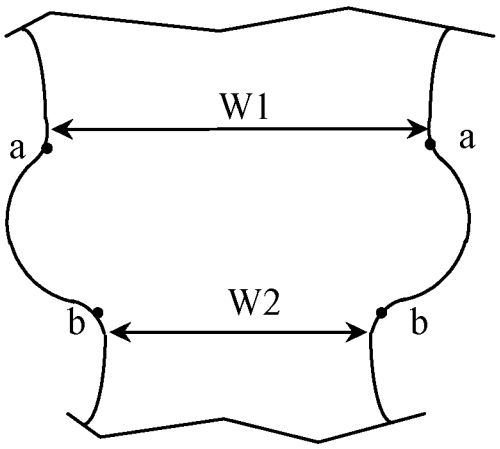

FIG. 8*b* illustrates a fabric cut useful in the process of FIG. 8*a*.

DETAILED DESCRIPTION OF THE INVENTION

Figure 1A:
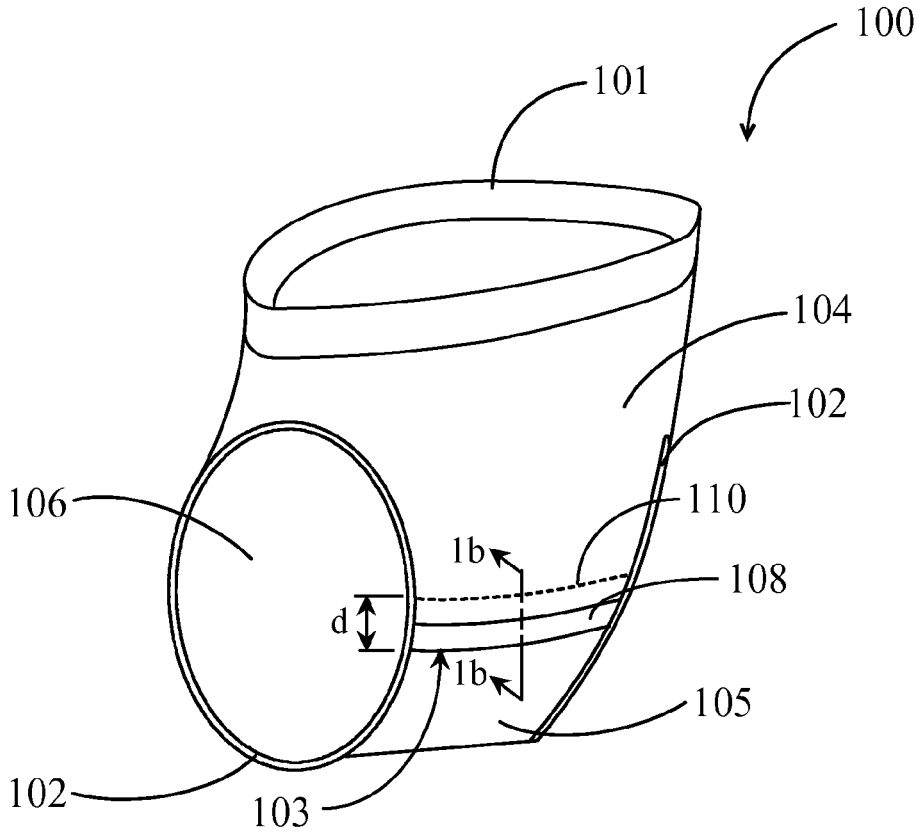

FIG. 1*a* is a side perceptive view of a male underwear brief 100, according to an embodiment of the present invention. Male underwear brief 100 comprises an elastic waistband 101 attached to the upper periphery of the brief 100, cloth material joined circumferentially to waistband 101 which forms a back panel 106, an upper front panel 104, and a crotch panel 105 proceeding from a lower region of the back panel 106 to the front and upward, a first and a second opening 102 for a person's legs and a horizontally oriented and aligned fly opening 103. The edges of the first and the second openings 102 for the person's legs are reinforced in most embodiments, and in most cases the reinforced edges are of elastic material.

In one embodiment horizontally oriented and aligned fly opening 103 is positioned low in the front of brief 100. Back panel 106 and crotch panel 105 are joined to reinforced edges of the leg openings 102. The upper front panel is joined to the reinforced edges of leg openings 102 as well, and ends at a horizontal elastic band 108 attached continuously to upper front panel 104. Horizontal elastic band 108 is attached to each of the reinforced edges of leg openings 102.

In one embodiment the upper extent of the material of crotch panel 105 is at line 110. This creates an overlapped fly opening 103 open from below upward into the brief, of a vertical dimension "d". This dimension may vary depending on the placement of both the upper end of the crotch panel, and the lower end of the upper front panel.

Figure 1B:
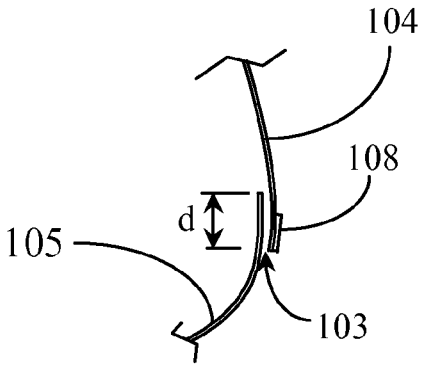

FIG. 1*b* is cross-section through horizontal fly 103 of FIG. 1*a* taken along section line 1*b*-1*b* into the brief. In this particular embodiment there is elastic band 108 overlying the upward-extending crotch panel material 105, but there is no band on the upper edge of crotch panel 105, which ends at line 110 (see FIG. 1*a*). In some cases this edge may be hemmed. Again, the placement and attachment of the crotch panel material and the upper panel material determine dimension "d", which may vary accordingly. The embodiment represented by FIG. 1*b* may be considered a "one-band" embodiment. In yet another embodiment upper front panel 104 may end without an elastic band, at an edge that may be, for example, hemmed as well, and this particular embodiment may be considered a "no band" embodiment, but nevertheless creates an upwardly opening overlapped horizontal fly opening of dimension "d".

Figure 1C:
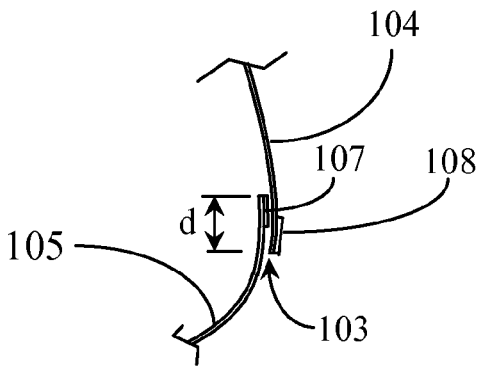

FIG. 1*c* illustrates the cross-section of the fly panel in another embodiment, wherein another elastic band 107 is added at the upper edge of the crotch panel. The elastic bands may be of equal height and weight, or different, and the overlap may be variously managed as described above. The embodiment represented by FIG. 1*c* may be considered a "two-band" embodiment. At least one other two-band embodiment is described additionally below.

Figure 2:
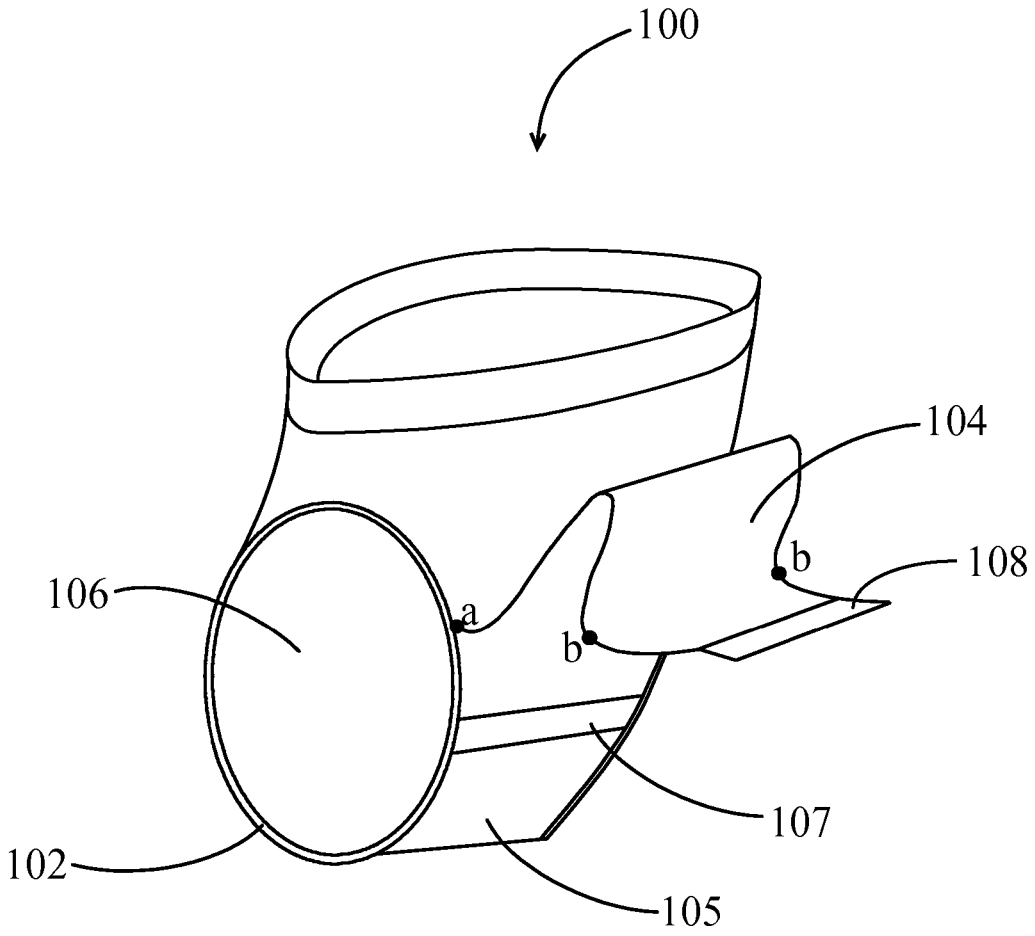
FIG. 2 is a side perceptive view of a male underwear brief indicating an upper front panel in an open condition, according to an embodiment of the present invention.

FIG. 2 is a side perceptive view of male underwear brief 100 illustrating another embodiment of a "two-band" brief, wherein a front pouch is also provided, not shown in the embodiments of FIGS. 1*a*, 1*b* and 1*c*. To better illustrate how a pouch is formed with the upper front panel, the upper front panel in shown in an open position in subsequent stages of assembly in FIGS. 2, 3, 4 and 5, according to an embodiment of the present invention. Crotch panel 105 proceeds upward from a lower region of back panel 106 to the front and ends at a first horizontal elastic band 107 joined securely to each of first and second leg openings 102, as shown in FIG. 1*c*. At this stage of assembly edges of upper front panel 104 are stitched to the elastic leg bands 102 down to point (a) as shown in FIG. 2. Note that point (a) is repeated on the opposite leg opening, although not seen in FIG. 2. The bottom edge of upper front panel 104 ends at and is joined to a second horizontal elastic band 108 as shown in FIG. 2.

Figure 3:
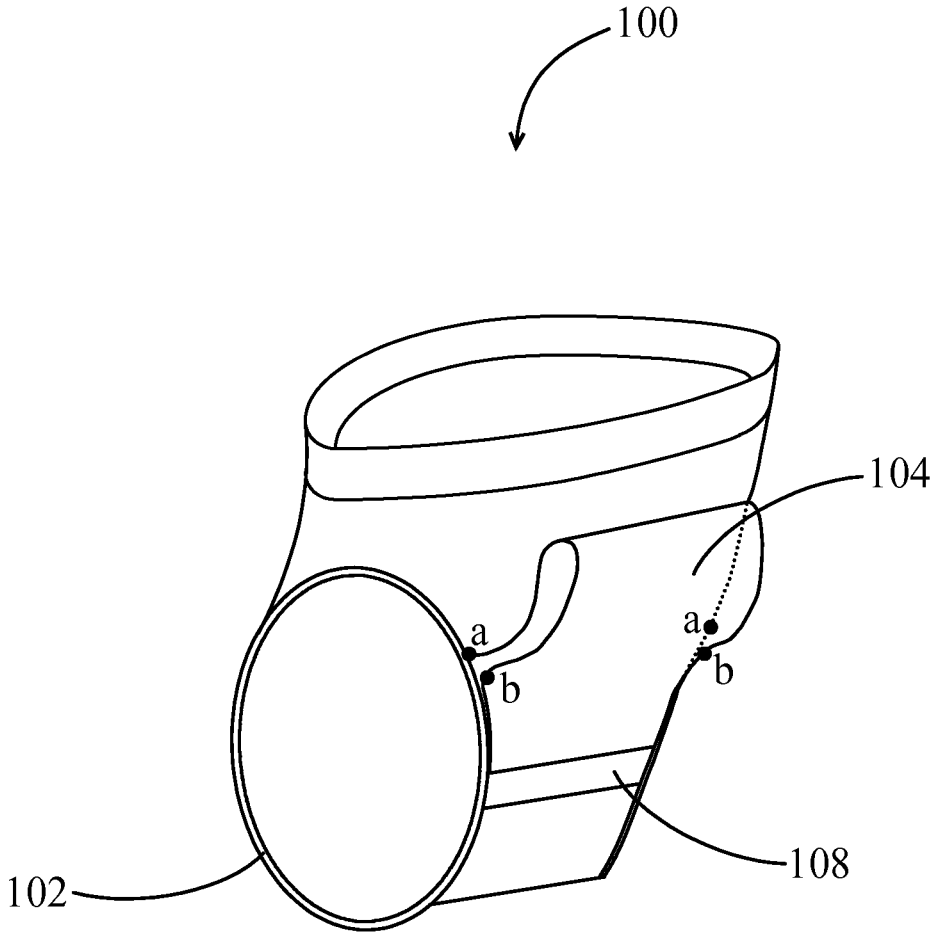
FIG. 3 is a side perceptive view of a male underwear brief indicating the upper front panel in a fixed and stitched condition, according to an embodiment of the present invention.

FIG. 3 is a side perceptive view of male underwear brief 100, illustrating the upper front panel in a fixed condition, according to an embodiment of the present invention. One side of upper front panel 104 is joined to the leg openings on both sides at two different points (a), (b) to form an extended loop as shown in FIG. 3. The opposite edges of horizontal elastic band 108 are stitched respectively to the reinforced edges of leg openings 102 at the opposite sides, and are positioned in one embodiment below the position of band 107, as seen in FIG. 1*c*. This is optional placement in different embodiments, and the position of band 108 may vary, affecting the dimension "d", FIGS. 1*b* and 1*c*. Further, the edges of the upper front panel are stitched to the reinforced edges of the leg openings as shown, down to the horizontal fly.

First horizontal elastic band 107 and second horizontal elastic band 108 are only stitched to the edges of the leg openings 102, leaving an opening up from the bottom of the horizontal fly to the inside of the brief.

Figure 4:
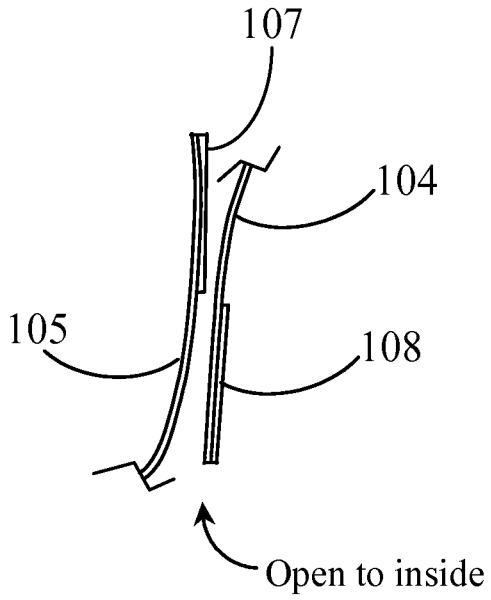
FIG. 4 is a cross sectional view of a male underwear brief indicating the arrangement of first horizontal elastic band and the second horizontal elastic band, according to an embodiment of the present invention.

FIG. 4 is a cross sectional view of the male underwear brief, essentially the same as FIG. 1*c*, illustrating the arrangement of the two horizontal elastic bands in this example. The bands are only stitched to the elastic leg bands 102. This leaves an opening up from the bottom of the fly to the inside of the upper front panel as shown in FIG. 4.

Figure 5:
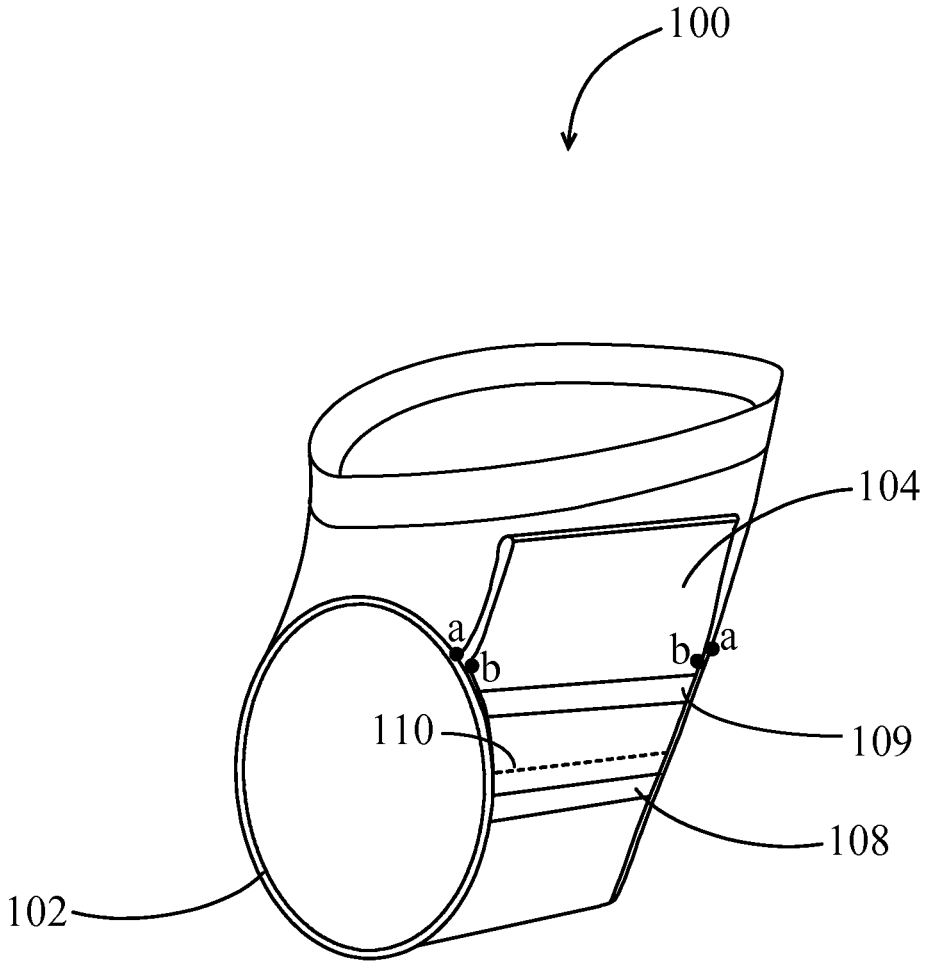
FIG. 5 is a side perceptive view of a male underwear brief indicating the arrangement of third horizontal elastic band, according to an embodiment of the present invention.

FIG. 5 is a side perceptive view of male underwear brief 100, illustrating the placement of a third horizontal elastic band 109, according to an embodiment. The upper front panel is folded, as shown in FIG. 3, with point (a) and point (b) relatively close together in this example, on both leg openings as shown. Third horizontal elastic band 109 is joined only to each of the reinforced edges of the leg openings 102 over the upper front panel 104 just above and parallel to second horizontal elastic band 108. The position of band 109 is below the attachment points (b) intentionally to provide support in use, as the pouch is intended to support a user's organ or organs.

Third horizontal elastic band 109 is stitched above second horizontal elastic band 108 and below attachment points (b) to each of the reinforced edges of the leg openings 102, but not to the upper front panel 104 or anywhere else. Since the third horizontal elastic band 109 is stitched only to the reinforced edges of the leg openings 102, it can be pulled outward. In alternative embodiments points (b) may be positioned on the edges of the leg openings further below points (a), providing a greater opening from inside into the pouch that is formed by the folded material, or the third horizontal elastic band 109 may be stitched continuously across the front panel.

Figure 6:
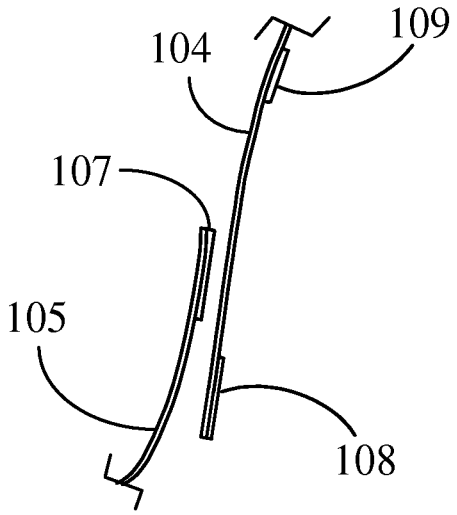
FIG. 6 is a cross sectional view of a male underwear brief indicating the arrangement of first horizontal elastic band, the second horizontal elastic band and the third horizontal elastic band, according to an embodiment of the present invention.
Figure 7:
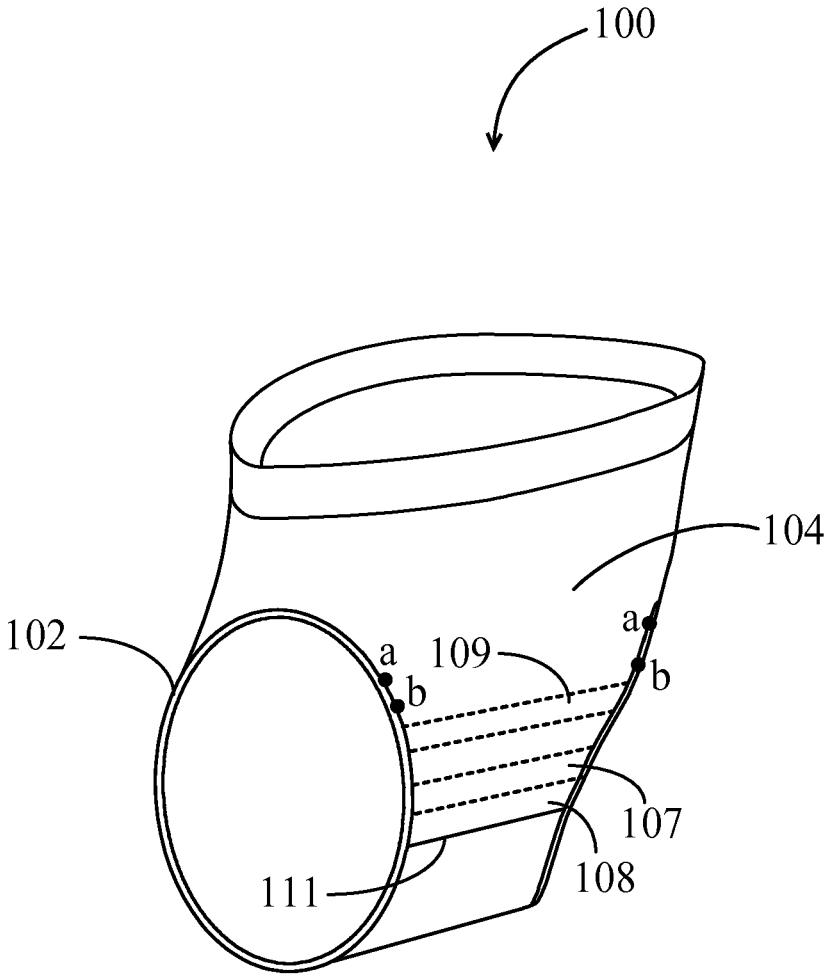
FIG. 7 is a side perceptive view of a male underwear brief with the upper front panel in closed position, according to an embodiment of the present invention.

FIG. 6 is a cross sectional view of the male underwear brief illustrating the arrangement of the three horizontal elastic bands in this example. Crotch panel 105 proceeds upwardly from a lower region of the back panel to the front and ends at first horizontal elastic band 107 attached continuously to the crotch panel and to each of the reinforced edges of the leg openings. Upper front panel 104 is joined to the reinforced edges of the leg openings and ends at horizontal elastic band 108 attached continuously to the upper front panel. Band 108 is attached to each of the reinforced edges of leg openings typically at some distance below band 107. This leaves an opening up from the bottom of the horizontal fly to the inside of the upper front panel 104 as shown in FIG. 6. In alternative embodiments the position of band 108 may be varied from directly over band 107 to substantially below band 107, varying the vertical dimension of the upwardly-extending opening into the brief. Band 109 is stitched above and parallel to band 108 to each of the reinforced edges of the leg openings at a distance that may vary, but is typically placed to support the pouch developed as shown in FIG. 5. FIG. 7 is a side perceptive view of male underwear brief 100 with the fold of the upper front panel in a closed position. The extended loop of upper front panel 104, as illustrated in FIGS. 3 and 5, has been folded downward. The folded loop is brought down, and the top edge of the loop comes right to the bottom edge of horizontal elastic band 108 at line 111. The side edges of the loop are stitched along the reinforced edges of the leg openings down to the horizontal fly thereby forming a pouch from within the brief along a horizontal line from points (a) and (b) on each leg opening. The relative positions of bands 107, 108 and 109 are shown now in FIG. 7 as dotted lines, because they are behind the folded down pouch material. It should be noted that the extent of material 104 may be adjusted, depending on a chosen distance between points (a) and (b), which define an opening size into an internal pouch, to provide the proper placement of edge 111.

In still another embodiment of the invention a front pouch may be formed by fabric cut, rather than by folding the fabric of the upper front panel as described in detail above. FIG. 8*a* is a perspective view of the brief showing horizontal elastic bands 107, 108 and 109. In this embodiment upper panel 104 is cut to provide a width w1 across points (a) to establish a dimension across the front of the brief, and another width w2 across points (b) below point (a) for the same purpose. W1 and w2 will typically be not the same, but w1 greater than w2.

FIG. 8*b* illustrates an exemplary cut for upper front panel material 104 with points (a) and (b) and widths w1 and w2. The edges are curved outwardly as shown between points (a) and (b). It is essential that the distance along the curve of the cut fabric from points (a) and (b) on each side be the same distance as between (a) and (b) on each leg band of the brief. This way, when the fabric is sewn to the leg bands on each side an outwardly-extending pouch may be formed. This pouch in use supporting a user's organ or organs will tend to form outwardly and downward as well.

Horizontal fly 103 can be stretched more than 25% to let the penis and scrotum, or just the scrotum out and to provide a slack-line-type closure for a supportive upper pouch (i.e. for upper front panel) 103 to hold the penis, or the penis and scrotum.

Horizontal fly 103 creates a comfortable collar close to the user's torso and the second horizontal elastic band, like a full-width fabric eyebrow, shrouds 1"-2" of the exposed organ, when the organ is pulled out. The first, second and third horizontal elastic bands may have a width of ½"-⅝" and are wrapped up for comfort in the brief 100.

In one embodiment, the male underwear brief in this example provides various options for the person to provide a continuous comfortable wearing for 24 hours every day. In one option the pouch formed of the extra material of the upper front panel covers and lifts both the penis and the scrotum, while slit-aperture horizontal fly 103 closes under the overhanging weight of the penis with the scrotum under. The pouch formed with the extended loop of the extra material of the upper front panel absorbs urine, reduces rolling and squeezing of organs between thighs and looks similar to jocks/briefs worn worldwide. In a second option the pouch covers and lifts only the penis up, or to one side while a slit-aperture (horizontal fly) 103 collars the scrotum. The scrotum may extend outside the brief which may be suitable for wear with most outerwear and in high humidity. In a third option horizontal fly 103 of the male underwear brief may let the penis out and collar the penis and the scrotum. The horizontal fly 103 further covers the pubic hair. The organs (penis and scrotum) may be pulled out and the buttocks region will stay covered without doffing the brief 100. The horizontal fly 103 creates a comfortable collar close to the user's torso, and the second horizontal elastic band 108 acts like a full-width fabric eyebrow, to shroud 1"-2" of the exposed organ.

It will be apparent to a skilled artisan that the embodiments described above are exemplary only, and that there may be many alterations made in these examples without departing from the spirit and scope of the invention.

The invention claimed is:

1. A male underwear brief, comprising:

an elastic waistband;

cloth material joined circumferentially to the waistband, contiguously forming a back panel, an upper front panel having a horizontal lower edge, and a crotch panel proceeding from a lower region of the back panel forward and upward, ending at a horizontal upper edge;

a first reinforced leg opening and a second reinforced leg opening;

an upper edge of a horizontal fly, the upper edge of the horizontal fly formed by the horizontal upper edge of the crotch panel stitched to the first and second leg openings;

a lower edge of the horizontal fly formed by stitching the horizontal lower edge of the upper front panel to the first and second leg openings below the first edge of the horizontal fly, providing an upward oriented horizontal opening into the brief, the upper front panel having a length substantially longer than the vertical distance from the upper edge of the fly opening and the waist band;

a forward-facing pouch formed by folding material of the length of the upper front panel and stitching the entire length of the joined edges of the folded material to the first and second leg openings;

a first elastic band joined continuously to the upper edge of the horizontal fly;

a second elastic band joined continuously along the lower edge of the horizontal fly; and a third elastic band joined to the first and second leg openings at a position above the upper edge of the horizontal fly.

2. The male underwear brief of claim 1 wherein the third elastic band is positioned horizontally over the material of the front panel to the outside of the underwear brief, providing support for the pouch.

* * * * *